United States Patent [19]

Kondo

[11] 3,952,754

[45] Apr. 27, 1976

[54] DANDRUFF REMOVING DEVICE

[76] Inventor: Yoshiaki Kondo, 1-12, Sakuranocho-5, Toyonaka, Osaka, Japan

[22] Filed: June 6, 1974

[21] Appl. No.: 477,034

[52] U.S. Cl. ..... 132/120

[51] Int. Cl.[2] ..... A45D 24/16

[58] Field of Search ..... 132/120, 108, 84, 85, 132/9

[56] References Cited

UNITED STATES PATENTS

| | | | |
|---|---|---|---|
| 106,680 | 8/1870 | Firey | 132/120 |
| 230,178 | 7/1880 | Deschamps | 132/85 |
| 3,053,264 | 9/1962 | Breton | 132/84 R |
| 3,133,546 | 5/1964 | Dent | 132/120 |

*Primary Examiner*—G. E. McNeill

*Attorney, Agent, or Firm*—Armstrong, Nikaido & Wegner

[57] ABSTRACT

A dandruff removing device detachably provided with a dandruff attracting portion which consists of a curved section thin metal plate coated with a chemical film layer, short lengths of synthetic resin filaments adhered to the outer surface of said layer by means of a binding agent, said portion detachably mounted to the device body through a thread engraved on one surface of the body thereby to remove the small scale flakes of dead skin formed on the head among the hair and the dust attached to the hair by electrostatic force of attraction caused to the filaments when the device is operated in frictional contact with the hair.

The invention further involves the art wherein substantially long lengths of filament bristles are set in the other surface of the device body to serve as a general type hair or cloth brush means.

7 Claims, 4 Drawing Figures

DANDRUFF REMOVING DEVICE

The present invention relates generally to improvements in a dandruff removing device, and more particularly to an implement provided with short lengths of synthetic resin filaments set in the implement body so as to tidy the hair and at the same time remove the dandruff and dust attached thereto.

Incidentally, the term "dandruff" herein used means the small thin scale flakes of hardened, dead outer skin which is formed on the head among the hair and becomes loose or separated from the healthy skin below, as in diseases and affections of the skin. The short work to keep the hair clean and prevent the head from becoming filthy with scurf is to wash the hair and massage the head skin with hair lotion.

In spite of the efforts directed to this work, however, dandruff still often comes off and falls for example on the shoulders, neck and flap portions of one's suit when the hair is brushed and combed in rubbing touch with the head skin. This is also the case with the dust attached to the hair. These scale flakes and dust are normally sticky partly due to hair oil on the hair and partly due to the sweat and adipose secreted from the head skin so that once attached to the suit portions these are quite difficult of being removed.

Referring to most of the conventional dandruff removing devices in general use, they are sorted in a broad way into the general type dandruff removing combs or brushes which are accessibly used by everyone irrespective of sex and age and also into the electrically operable dandruff absorbing machines for special use in tonsorial art and beauty treatment.

Thus in order to remove these fallen scale flakes and dust, use is independently made of such a dandruff remover for example as an electric motor driven type dandruff absorbing machine equipped with a vacuum tube. The result is that the user must operate an independent dandruff remover posterior to a hair brushing or combing operation and take a lot of time in removing the dandruff additionally to the time he has spent in the operation.

A further disadvantage is also caused that for the purpose of removing the fallen scale flakes and dust on the suit portions, a dandruff remover must be independently purchased for personal use which is generaly almost same as, or more expensive in market price than, the hair brush of a user's possession.

Accordingly, the present invention has been designed to eliminate all the above-mentioned drawbacks and disadvantages, and has as one of its main objects the provision of a dandruff removing device provided with a particular element effectively attracting the dandruff and dust of the hair.

Another object of the invention is to provide a dandruff removing device which is structurally so simplified as is easily accessible to everyone thereby to accomplish the two purposes of smoothing the hair and at the same time removing the scale flakes that come off the hair.

A further object of the invention is to provide a dandruff removing device which is light enough to be freely operable with a single hand as long as a user wants.

A still object of the invention is to provide a dandruff removing device whose dandruff attracting or removing portion is detachably mounted on a device body and easily removable from the same when cleaning is necessary.

These and other objects, features and advantages of the present invention will become apparent from the following detailed description when taken in conjunction with the accompanying drawing, in which.

Figure 1:
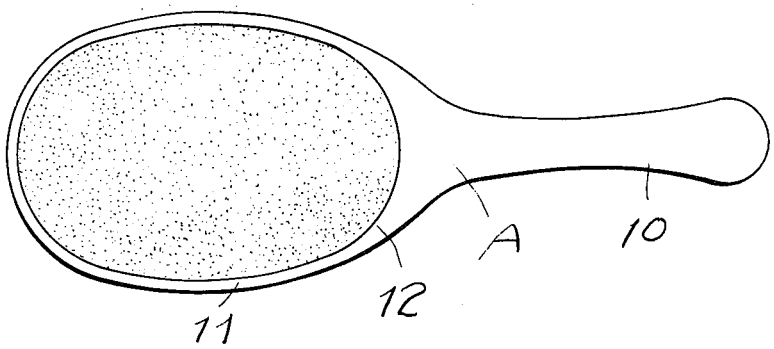
FIG. 1 is a top surface view showing one of the preferred embodiments of the invention.

Referring now to the accompanying drawing, and first more particularly to FIg. 1 definitely showing one of the preferred embodiments of the invention, reference character A designates a dandruff removing device body. Said body A comprises a hand grip portion 10 formed so as to be easily grasped with one hand, and a flat dandruff remover supporting portion 11 extended integrally from said grip portion 10.

Said supporting portion 11 in the present embodiment is formed in an elliptical shape. However, this may be formed in any other suitable shape for the reasons described hereinafter. Said supporting portion 11 has at one side a continued elliptical thread 12 engraved close to the outer circumference of said supporting portion 11 along therewith.

Figure 2:
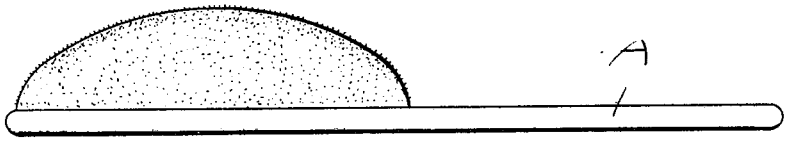
FIG. 2 is a side elevation view thereof.
Figure 3:
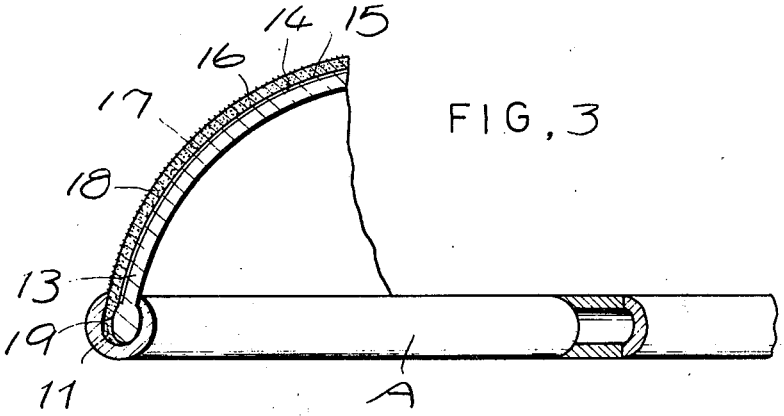
FIG. 3 is an enlarged cutaway side elevation view thereof for more clarity of the elemental parts of FIG. 2.

Reference numeral 13 clearly shown in FIGS. 2 and 3 denotes a light weighted thin metal plate which is preferably composed of an aluminium material. The outer surface area of said plate 13 is coated therethrough with a chemical film layer 14 composed preferably of either phosphate or chromate.

Further on the whole surface area of said layer 14 is spread a binding agent 15 which comprises either of rubber, synthetic rubber or acrylic resin material. Thereafter, short lengths of filaments 16 comprising nylon, Tetoron or other similar synthetic resin are adhered in densely close relation with each other to said chemical film layer 14 under known electrothermic treatment by means of said binding agent 15 thereby to form a base plate 17.

The base plate 17 formed in the above-mentioned manner is then bent into a curved section configuration as definitely shown in FIG. 3 to result in a dandruff attracting portion 18 being formed. Being composed of the thin metal plate or aluminium plate 13 as has already been mentioned, said attracting portion 18 has a slight resiliency so that it is resiliently mountable to the device body A by forcibly inserting the lowermost edge 19 of the portion 18 into the elliptical thread 12 engraved close to the outer circumference of said portion 11.

In the above-mentioned embodiment of the present invention, disclosure has been made of the method in which the elliptical thread 12 is engraved along the elliptical configuration of said supporting portion 11 so as to permit the dandruff attracting portion 18 to be mounted to the device body A. However, it is easily understood that many other methods are applicable to accomplish this mounting effect since dandruff removing devices in general use are principally utilized by many people irrespective of sex and age. Thus in most cases an ornamentally added design value is more strongly required than practically serviceable value so as to please everyone's preference.

In order to effect the above-mentioned purpose, a suitable number of notches or slits (not shown in the accompanying drawing) may be formed at properly spaced apart intervals with each other on said supporting portion 11 in close relation to the outer circumference of the latter portion 11 whereas the lowest circumferential edge 19 of the dandruff attracting portion 18 is cut to form tongues (not shown) having the number equal to said suitable number of the notches so as to be rigidly insertible into said notches or slits, consequently these tongues are resiliently mounted to the supporting portion 11 through said notches or slits.

The aforesaid mounting method may also be replaceable by mounting the dandruff attracting portion 18 to the supporting portion 11 through means of suitable screen screwably engaged with these portions 11 and 18. Further in case the attracting portion 18 is required for a circular shape design in order to enhance the ornamental effect of the device body A, an annular thread may be engraved on the supporting portion 11 while the lowermost circumferential edge 19 of the attracting portion 18 may be formed in an Edison screw thread thereby screwably inserting the latter into said annular thread.

The dandruff attracting or removing portion 18 mounted on the device body A in any of the above-mentioned manners is fixed separably in substantially perpendicular direction, and inseparably in substantially horizontal direction, with respect to the plane of the device body A. In practical use, the dandruff removing deive of the present invention is operated frictionally on the hair in substantially parallel direction to the plane of the device body A so that a user is able to operate the device with a desired brushing force, free of a fear that the attracting portion 18 should be taken off the supporting portion 11.

As clearly mentioned in the foregoing, the attracting portion 18 in the invention is composed of nylon, Tetoron or other suitable synthetic resin filaments which easily cause an electrostatic force of attraction when the outer surface area of the attracting portion 18 is subjected to a slight frictional movement so that by frictionally applying to the hair, the attracting portion 18 is caused to effect frictional brushing operation and at the same time attract the small scale flakes of the outer dead skin formed on the head among the hair and the dust attached to the hair under the influence of electrostatic force of attraction cuased by said frictional brushing operation.

In addition to the above-mentioned hair brushing and dandruff attracting services, the dandruff removing device of the invention serves as a common-sense cloth brush means when applied to clothes and coats which a user has worn thereby removing the dust attached thereto and further increasing the nap raising effect thereof.

A further advantage with the dandruff removing device of the invention is that the dandruff and dust accumulatively attached to the surface of the attracting portin 18 can be cleaned by rubbing said surface with any other brush means at hand since the attracting portion 18 is detachably mounted on the device body A in substantially perpendicular relation with respect thereto as already referred to. Said attracting portion 18 can also be kept in sanitary condition and restore its effective electrostatic force of attraction by removing the portion 18 off the device body A and treating the same through washing, rinsing and drying operations.

Figure 4:
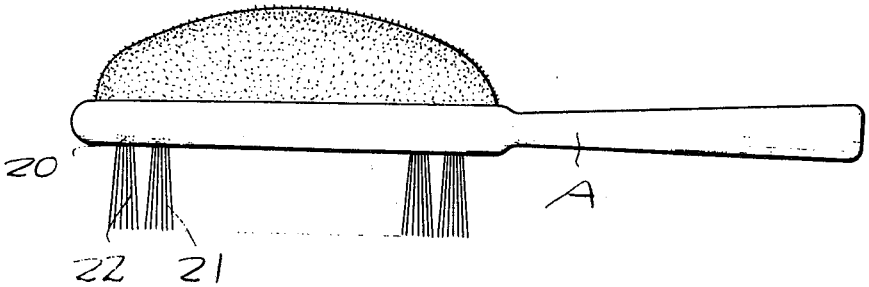
FIG. 4 is a side elevation view showing the whole body of the invention, wherein a general type hair brush element is applied to the device body integrally with the dandruff removing device of the invention.

In FIG. 4 of the accompanying drawing is illustrated an example wherein the dandruff removing or attracting device of the invention serves as a common-sense hair or cloth brush means by forming a plurality of blind or through holes 20 on said supporting portion 11 at the opposite side to the surface of the supporting portion 11 supporting said attracting portion 18 and setting in each of the holes a bristle or bristles 22 comprising long lengths of synthetic resin filaments 21.

Though one specific embodiment of the present invention has been shown and described herein, it will be apparent to those skilled in the art that the invention is not restricted to the details set forth hereinbefore but many changes and modifications may be made without departing from the spirit and scope of the invention as defined in the annexed claims.

What is claimed is:

1. A dandruff removing device comprising a. a body, b. a particle removing portion having a curved configuration comprising:

a light weight thin metal plate, a chemical film layer coated thereon, and electrostatic means including short lengths of synthetic resin filaments set in the outer surface of said portion by use of a binding agent for attracting particles thereto, c. a mounting thread engraved on one side of said device body so as to permit said portion to be detachably mounted on said mounting thread, d. a plurality of holes bored on the other side of said device body, and e. substantially long lengths of synthetic resin filament bristles inseparably set in said other side of the device body through said holes substantially in a normal direction with respect to said device body.

2. The dandruff removing device, as set forth in claim 1, wherein said metal plate comprises a thin aluminium plate.

3. The dandruff removing device, as set forth in claim 1, wherein said short lengths of filaments comprise Tetoron quality filaments.

4. The dandruff removing device, as set forth in claim 1, wherein said short lengths of filaments comprise nylon quality filaments.

5. The dandruff removing device, as set forth in claim 1, wherein said chemical film layer is composed of phosphate.

6. The dandruff removing device, as set forth in claim 1, wherein said chemical film layer is composed of chromate.

7. The dandruff removing device, as set forth in claim 1, wherein said binding agent comprises either of rubber, synthetic rubber and acrylic resin paste material.

* * * * *